United States Patent [19]

Hunter

[11] Patent Number: 4,796,809

[45] Date of Patent: Jan. 10, 1989

[54] TWO-STAGE POP-UP SPRINKLER

[76] Inventor: Edwin J. Hunter, 5551 Codorniz Rd., Rancho Santa Fe, Calif. 92067

[21] Appl. No.: 49,843

[22] Filed: May 15, 1987

[51] Int. Cl.[4] ..... B05B 3/04; B05B 1/34; B05B 15/10

[52] U.S. Cl. ..... 239/205; 239/206; 239/461

[58] Field of Search ..... 239/200, 201, 203, 204, 239/205, 206, 461

[56] References Cited

U.S. PATENT DOCUMENTS

| | | | |
|---|---|---|---|
| 963,944 | 7/1910 | Saltlamachia | 239/206 |
| 1,853,805 | 4/1932 | Elder | 239/205 |
| 2,054,964 | 9/1936 | Barker | 239/461 |
| 3,035,778 | 5/1962 | Kimbro et al. | 239/206 |
| 3,080,123 | 3/1963 | Erns | 239/230 |
| 3,583,638 | 6/1971 | Eby | 239/206 |
| 4,113,181 | 9/1978 | Sheets | 239/206 |

FOREIGN PATENT DOCUMENTS

| | | | |
|---|---|---|---|
| 1256534 | 12/1971 | United Kingdom | 239/206 |

*Primary Examiner*—Andres Kashnikow
*Assistant Examiner*—Christopher G. Trainor
*Attorney, Agent, or Firm*—Baker, Maxham & Jester

[57] ABSTRACT

A two-stage pop-up sprinkler unit includes a cylindrical housing having a first telescoping sleeve reciprocably mounted in the housing and a second sleeve telescoping mounted within the first sleeve and containing the sprinkler head and driving mechanism, the first sleeve extending from the housing first for clearance of the ground surface and the second sleeve extends from the first sleeve with the head cleared to begin distributing water.

9 Claims, 3 Drawing Sheets

TWO-STAGE POP-UP SPRINKLER

BACKGROUND OF THE INVENTION

The present invention relates to sprinkler systems and pertains particularly to pop-up sprinkler systems.

Sprinkler units which retract into a housing in the ground when not in use, and which pop-up or extend from a housing in the ground when water pressure is supplied thereto, are widely used in both residential and commercial applications. The present pop-up type sprinkler units begin to operate as soon as water pressure is supplied thereto and the unit begins its rise from the housing. This operation of the unit before it clears the ground surface results in erosion of soil around the unit causing a large hole or cavity in the ground.

This operation may be tolerated for some situations, but is not satisfactory for most applications. For example, such units clearly cannot be used on putting greens of golf courses. Presently, putting greens of golf courses are watered by sprinkler units located off the green or by portable units that are moved onto and off the green as needed. These two approaches have a number of drawbacks, including labor, lack of adequate coverage and potential damage to the green.

It is, therefore, desirable that an improved pop-up sprinkler be available that can be utilized on putting greens.

SUMMARY AND OBJECTS OF THE INVENTION

It is the primary object of the present invention to provide an improved pop-up sprinkler unit.

In accordance with a primary aspect of the present invention, a sprinkler unit comprises a housing having a first telescoping sleeve for extending clear of ground surface and a second sleeve for extending the sprinkler head clear of the first sleeve for distributing water.

BRIEF DESCRIPTION OF THE DRAWINGS

The above and other objects and advantages of the present invention will become apparent from the following description when read in conjunction with the accompanying drawing wherein.

DETAILED DESCRIPTION OF A PREFERRED EMBODIMENT

Figure 1:
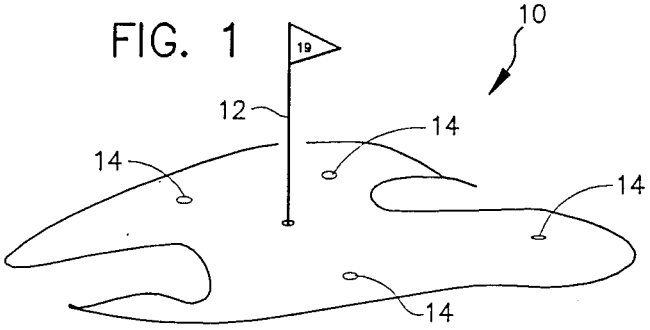
FIG. 1 illustrates a perspective view of a golf green embodying a sprinkler unit according to the invention.

Referring to FIG. 1 of the drawings, there is illustrated a typical golf green, designated generally by the numeral 10, having a flag 12 marking a hole and embodying a plurality of sprinkler units in accordance with the invention, designated generally by the numeral 14. The sprinkler units 14 are buried beneath the turf of the green and arranged to maintain the continuity of the turf.

Figure 2:
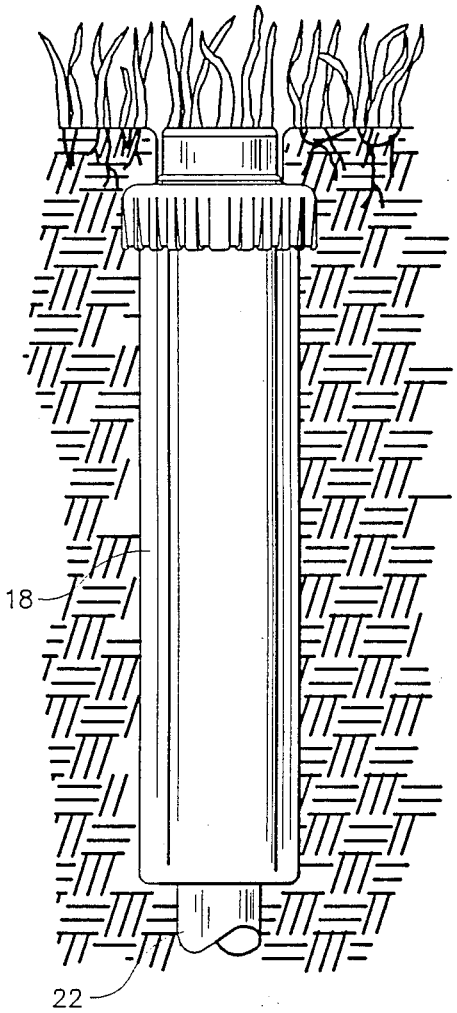
FIG. 2 is a side elevation view showing the unit in place beneath the surface of the ground and in the retracted position.

Referring to FIG. 2, a preferred embodiment of a pop-up sprinkler unit in accordance with the invention is illustrated in the mounted or installed and retracted position. The unit has a cup 16 mounted on top of the unit containing a plug of grass mounted therein to fill the top of the hole in which the unit is mounted. The cup 16 must have a diameter of at least large enough to fill a hole large enough to accommodate the portion of the unit that extends or pops up to expose the nozzle. The cup may be larger, if desired, such as about equal to or slightly greater than the maximum diameter of the sprinkler unit housing.

Figure 5:
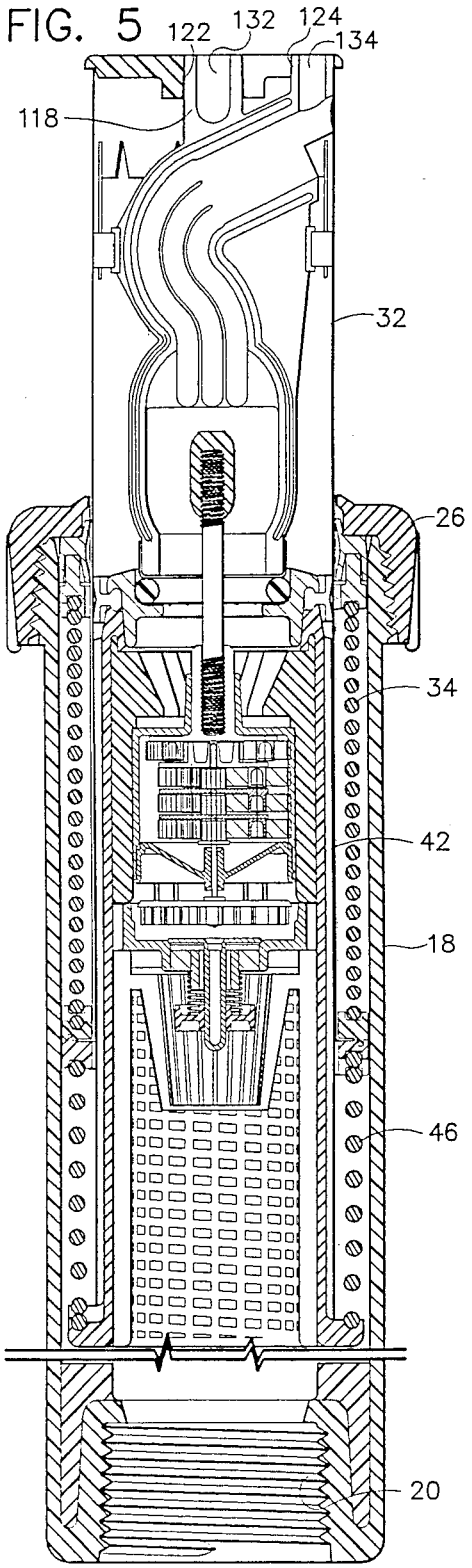
FIG. 5 is a view like FIG. 4 showing the unit in in the first stage of extension.
Figure 4:
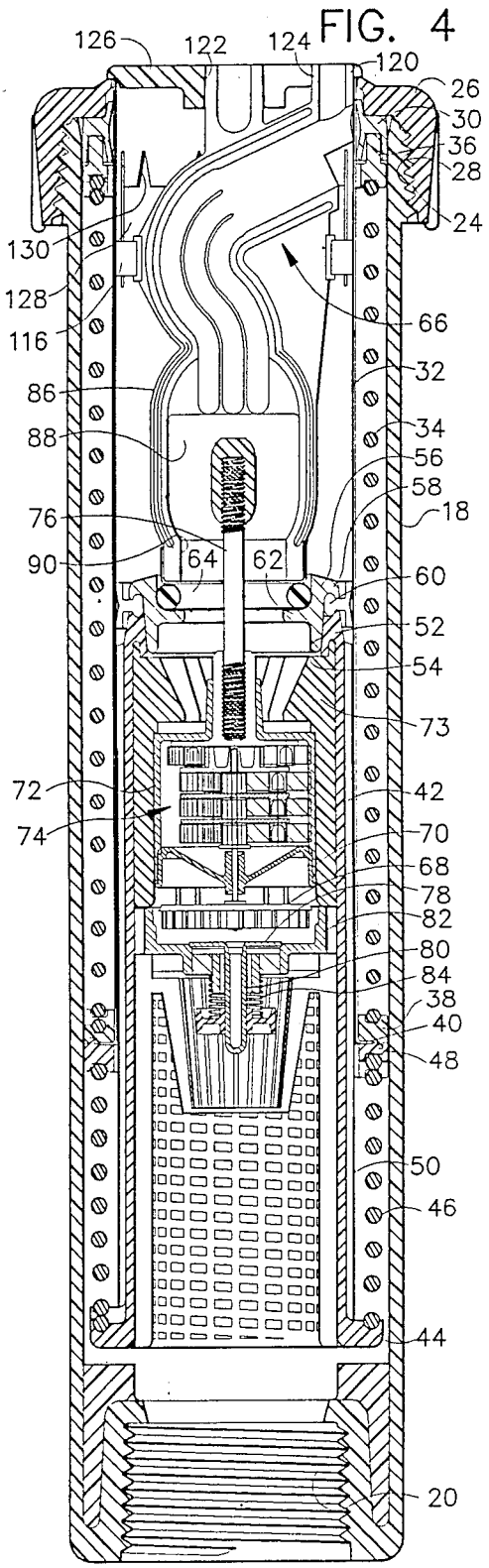
FIG. 4 is a side elevation view in section showing the unit in the fully retracted position.
Figure 7:
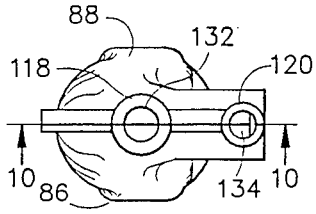
FIG. 7 is a top view of the unit of FIG. 6.

The sprinkler unit, as best seen in FIGS. 4 and 5, comprises an elongated tubular generally cylindrical housing 18, having an inlet end with a threaded inlet port 20 for attachment to a riser 22 or other source of pressurized water. An outlet end has outer peripheral threads 24 for receiving an annular retainer cap 26, having internal threads 28, which detachably attaches to the end of the housing. The annular retainer cap 26 engages and retains an annular seal 30 in place for engaging and sealing against the outer cylindrical surface of an upper or outer telescoping sleeve 32, which is retractably telescopically mounted within the housing.

The outer tubular sleeve 32, which is preferably constructed of a material such as stainless steel, is reciprocably mounted within the bore of the outer housing 18 and is biased to a retracted position by a compression spring 34. The compression spring 34 engages and biases at the upper end against an annular ring 36 that engages the aforementioned annular seal 30, and against a ring 38 at the opposite end of the sleeve which engages a radial flange 40 of the sleeve. A stainless steel or the equivalent construction of this sleeve has advantages in that it resists abrasion from contact with surrounding soil and the like.

Reciprocably mounted within the housing 18 and extending into outer sleeve is an inner sleeve 42, which is generally tubular in configuration having a radial flange 44 at the lower or inner end, which is engaged by a second compression spring 46. This second compression spring 46 engages an annular retaining ring 48, which engages the radial flange 40 of the outer sleeve 32. The sleeve 42 has radially outwardly extending ribs 50 that extend along the outer surface thereof to provide low friction support of the inner sleeve 46 in the outer sleeve 32.

An upper annular mounting flange 52 of sleeve 42 has a tapered bore 54 for mounting a ring 56, having a matching outer tapered surface and a radial flange 58 for mounting an annular seal 60, which seals against the inner surface of sleeve 32. An inwardly directed flange 62 mounts a seal or 0-ring 64 for sealing a nozzle to be described.

Mounted and carried on the upper end of the inner sleeve 42 is a rotary nozzle 66. A drive mechanism for the rotary nozzle is mounted on the upper or outlet end of the sleeve 42 for extending outward from the upper end of the outer sleeve 32. The inner sleeve 42 is sealingly mounted within the outer sleeve 32 by an annular seal 60 retained against shoulder 52 at the upper end of the sleeve and by an annular shoulder 58 on annular retainer 56. The retainer 56 has a slightly tapered outer surface which seats in a tapered bore 54 at the upper end of the sleeve 42.

Driving means for driving the rotary sprinkler nozzle 66 includes water driven annular turbine blade or wheel 68, which is rotatably mounted within a support member or end cap 70 of a gear housing 72 supported within an inner bore of a rib insert 73 of the inner sleeve 42. The turbine wheel 68 is drivingly connected to a reduction drive unit 74 having an output shaft 76 extending coaxially of the housing unit. The drive shaft 76 is threaded at both ends and drivingly connects the output of the reduction drive unit 74 to a sprinkler head or nozzle 66. The driving impeller and the reduction drive unit may be constructed as more fully described in my U.S. Pat. No. 3,854,664, dated Dec. 17, 1974 and incorporated herein by reference as though fully set forth.

A one-way check valve comprises a radial valve disc 78, having an axially extending stem 80 mounted within a bore in a support member 82, and biased by a spring 84 of a compression type engaging against the annular support structure, and against an annular retaining disc on the outer end of the stem.

The nozzle unit as illustrated in FIGS. 6–11 comprises a nozzle defined by a complex body of two opposing half-shells 86 and 88. The two shells are fitted together defining a body having an elongated water passageway connecting between a generally circular inlet opening 90 at one end, and a generally rectangular outlet opening 92 at the other end. The nozzle is designed to take a generally axially flowing stream of water and change its direction, and direct it outward at an angle of on the order of about 25 degrees or so relative to the axis of original flow. The nozzle is constructed to provide a highly efficient flow of the water by substantially eliminating turbulence in the water flowing therethrough as it makes its turn in changing direction. The highly efficient flow increases the reach or distance of the stream which flows from the nozzle.

Figure 10:
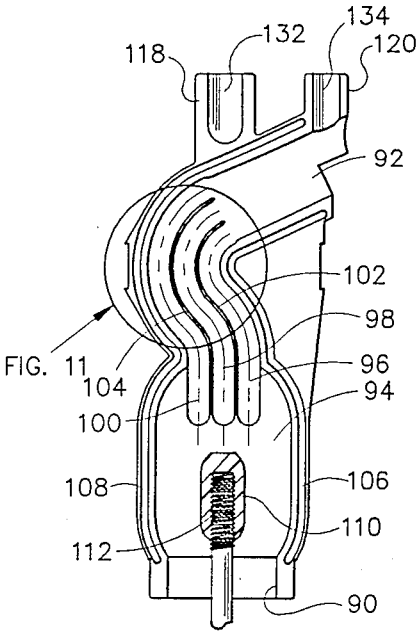
FIG. 10 is a side elevation view showing the inside of one-half of the nozzle.
Figure 6:
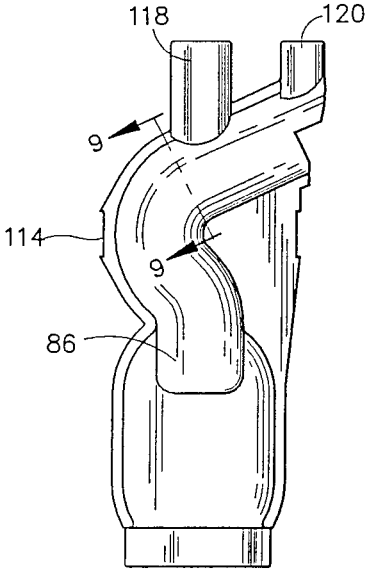
FIG. 6 is a side elevation view of the nozzle unit.
Figure 8:
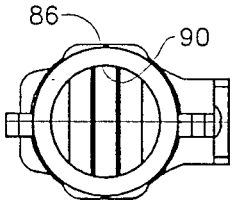
FIG. 8 is a bottom end view of the nozzle.
Figure 11:
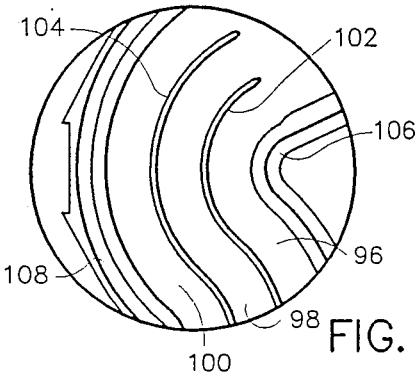
FIG. 11 is an enlarged view of a portion of FIG. 10.
Figure 9:
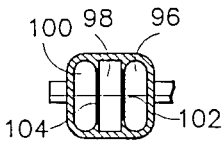
FIG. 9 is a section view taken on line 10—10 of FIG. 6.

As best seen in FIG. 10, the inlet end of the passageway is formed by an initial barrel like chamber 94 leading to a plurality of adjacent curved channels 96, 98 and 100, which form narrow passageways extending from the initial inlet channel to to a straight section of the passage adjacent the outlet. The channels 96, 98, and 100 are formed by thin walls 102 and 104, which divide the stream into narrow streams for reducing turbulence of the water as it changes direction as it flows from the inlet 90 of the nozzle to the outlet 92. These channels have generally rectangular cross-sections, with the passage gradually changing from generally rectangular to a round shape at the outlet to receive various nozzle inserts retained in place by a screw in bore 134.

The nozzle body is curved in a manner to maximize the radius of curvature of the channel or passage relative to its width, which also acts to reduce the amount of turbulence generated as the stream turns. The combination of the reduced width of the channels and the greater radius of curvature of the channels minimizes the turbulence in the nozzle. It will be appreciated that when water flows along a curved channel, the water at the outside of the curve must travel faster than that at the inside of the curve. This difference in velocity causes turbulence and is minimized in the instant construction.

As best illustrated in FIG. 10, the flow channel or passage of the nozzle has an initial entrance section that is axial of the axis of the housing and of the nozzle. The passage curves first to the left and back to the right and exits along a straight section that extends at an angle of about 25 degrees to the axis. The passage in the illustrated embodiment forms an arc between the inlet and outlet sections that has an axis at a position slightly to the right of the axis of the housing and of the nozzle. In other words, the straight section of the passage is to one side of the housing axis, and the axis of curvature of the passage is on the other.

The nozzle as illustrated is constructed of a two-piece housing of mirror image half-shells 86 and 88 designed to fit together to form the whole nozzle. As shown in FIG. 10, an open side of the shell 88 reveals the edges of the shell walls, with grooves 106 and 108 for receiving corresponding tongues or ridges (not shown) from the edges of the opposite shell 86. Each shell is provided with one spoke, only one 110 shown, which forms one-half of a bore 112 for receiving the end of drive shaft 76. The two half-shells may be made of any suitable material, such as metal or plastic and formed by molding or the like.

The two shells of the nozzle may be secured together by any suitable means, such as welding, soldering, gluing or the like. The nozzle body is formed with a recess 114 for receiving a roller bearing 116 for mounting the nozzle for rotation within the sleeve 32. The nozzle is also formed with a first cylindrical extension 118 axially thereof and a second cylindrical extension 120 adjacent the outlet thereof. These extensions extend into cylindrical bores 122 and 124 of a circular cap 126, which has a circular peripheral rim for engagement with the outer end of the sleeve 32 and with the retainer cap 26. The cap 126 also helps support the plant cup or container 16. The axial extension 118 has a blind bore 132, which may be used for receiving a screw or the like for mounting purposes. The extension 120 has a through bore 134 for receiving a retaining screw for engaging and retaining a nozzle insert that detachably mounts in the outlet end 92 of the flow passage. It may also be used as a mounting bore for a screw or the like.

An annular seal in the form of an O-ring 64 (FIGS. 4 and 5) engages between an annular shoulder 62 and the lower or inlet end of the nozzle body and seals the inlet to the nozzle unit. The nozzle unit 66 is rotatably mounted on the end of the drive shaft 76 of the reduction drive unit 74, and in the sleeve 32 by means of a roller bearing 116. The roller bearing 116 has an inner race secured to the nozzle body 86, and sleeve 32 forms an outer race for the bearing rollers.

The rollers of the roller bearing carry a cage unit, which carries a stream interrupter 128 in the form of a circular or annular band having upwardly extending fingers 130, which pass in front of the lower portion of the nozzle extending into the flow stream and rotate at a different rotation rate to that of the nozzle. The fingers 130 intermittently interrupt the lower portion of the water stream on an irregular basis as the nozzle rotates. This enhances the water distribution.

The cup 16 for retaining a plug of grass is carried by the upper end of the nozzle unit for covering the hole in the ground within which the nozzle unit retracts. This provides a convenient means for providing a uniform grass surface when the nozzle is retracted. This makes the sprinkler unit suitable for being placed on putting greens and the like for automatic and uniform watering thereof.

Figure 3:
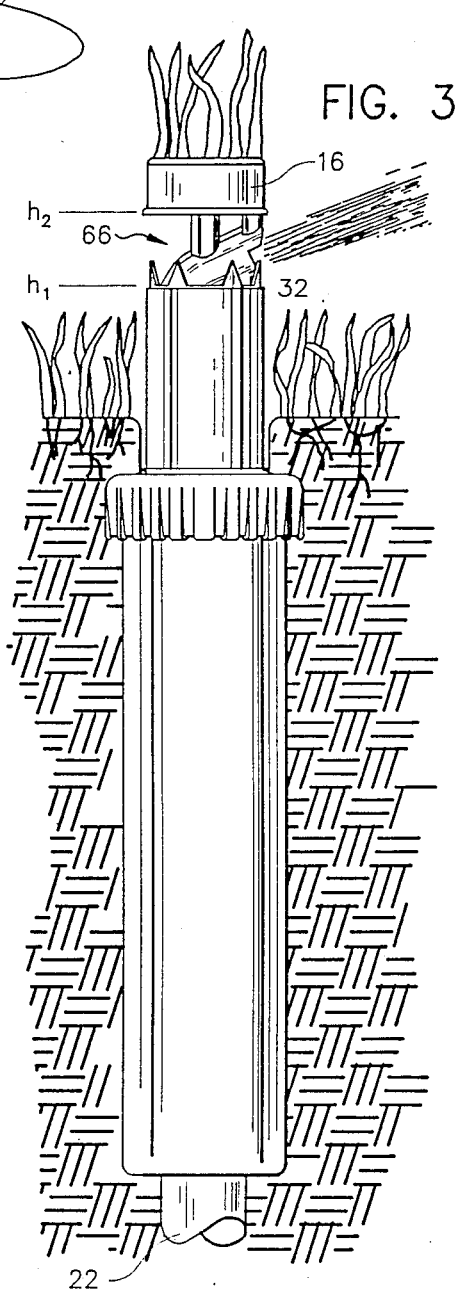
FIG. 3 is a side elevation view showing the unit in place beneath the surface and in the fully extended position for operation.

In operation, the unit is normally in the retracted position, as shown in FIG. 2. When pressurized water is supplied, the unit operates by telescopically extending in a first stage to a position, as shown in FIG. 5, wherein the upper spring 34 bottoms out, extending the inner or outer sleeve 32 to a position where the outlet of the nozzle is above the surface of the ground while the nozzle is retained protectively encased within the sleeve 32. Upon reaching the bottoming out of the upper spring 34, the lower spring 46, which is relatively stronger, begins to compress, permitting the inner sleeve 42 to telescopically move upward within the outer sleeve 32. The upward movement of the inner sleeve carries the nozzle 66 at the upper end thereof outward beyond the upper end of sleeve 32, exposing the outlet of the nozzle, as shown in FIG. 3. As soon as the nozzle 66 begins to emerge from the upper end of the outer sleeve 32, the water begins flowing from the nozzle outlet and the nozzle begins rotating and distributing water in the usual pattern.

With this operation, the pop-up sprinkler unit pops up in a two-stage fashion with sleeve 32, keeping the nozzle encapsulated until clearance of the ground surface. The nozzle then pops out of the upper end of sleeve 42 after it has cleared the ground surface, thus eliminating the typical erosion problems common with the prior art.

While I have illustrated and described my invention by means of specific embodiments, it is to be understood that numerous changes and modifications may be made therein without departing from the spirit and scope of the invention as defined in the appended claims.

I claim:

1. A pop-up sprinkler unit with protective sleeve, comprising:

an elongated outer housing having a cylindrical bore with inlet means and outlet means communicating with said bore;

an elongated inner housing having an upper end and a lower end and reciprocably mounted in said cylindrical bore for movement between a retracted position within said bore and an extended position extending from said bore of said outer housing; and a nozzle mounted on said upper end of said inner housing and moveable with said inner housing between the retracted position within said bore and the extended position extending from said bore of said outer housing, said nozzle comprises an elongated passage having a curved portion between an inlet thereof and an elongated straight outlet section extending outward at an angle to the axis of the housing, and further comprises means in said curved portion dividing said curved portion into a plurality of separate passages for inhibiting turbulence in water flowing from said outlet, said curved passageway extending to one side of the rotary axis of said nozzle, and the straight outlet section extending to the other side of the axis; and elongated protective sleeve means normally disposed in a protective position between said nozzle and said outer end of said inner housing and said outer housing solely for protectively covering said nozzle and for movement with said inner housing between the retracted position within said bore and the first extended position extending from the outlet end of said bore.

2. A sprinkler unit according to claim 1 wherein:

said nozzle is rotatably mounted on said upper end of said inner housing, and turbine means in said inner housing for rotating said nozzle.

3. A sprinkler unit according to claim 1 wherein said protective sleeve is constructed of a sheet metal.

4. A sprinkler unit according to claim 3 wherein said sheet metal is stainless steel.

5. A protected nozzle pop-up sprinkler unit comprising:

a first elongated tubular housing having a cylindrical bore with inlet means for attachment to a source of pressurized water and outlet means communicating with said bore;

a second elongated tubular housing having an upper end and a lower end and reciprocably mounted in said first housing for movement between a retracted position within said bore and an extended position extending from the outlet means of said bore;

a nozzle rotatably mounted on said upper end of said second housing and moveable therewith between said retracted position and said extended position, said nozzle comprises an elongated passage having a curved portion between an inlet thereof and an elongated straight outlet section extending outward at an angle to the axis of the housing, and further comprises means in said curved portion dividing said curved portion into multiple separate passages for inhibiting turbulence in water flowing from said outlet, said curved portion of said passageway extending to one side of the rotary axis of said nozzle and the straight outlet section extending to the other side of the axis;

turbine means in said second housing for rotating said nozzle;

elongated protective tubular sleeve means reciprocably mounted between said first and second housing solely for protectively covering said nozzle and said upper end of said second housing until said second housing is extended to a first position wherein said sleeve is restrained from further extension and said nozzle is cooperatively extended from said sleeve; and retracting means for biasing said second tubular housing and said sleeve to said retracted position.

6. A multi-stage pop-up sprinkler unit according to claim 5 wherein said tubular sleeve is stainless steel.

7. A multi-stage pop-up sprinkler unit according to claim 6 wherein said second housing includes a plant container mounted thereof for containing soil and plants and for movement therewith.

8. A multi-stage pop-up sprinkler unit comprising:

a first elongated tubular housing having an axially extending cylindrical bore with inlet means for attachment to a source of pressurized water and outlet means communicating with said bore;

a second elongated tubular housing having an upper end and a lower end reciprocably mounted in said housing for movement between a retracted position within said bore and an extended position extending from the outlet means of said bore;

a nozzle comprising an elongated passage having a curved portion between an inlet thereof and an elongated straight outlet section extending outward at an angle to the axis of the housing, and further comprises means in said curved portion dividing said curved portion into multiple separate passages for inhibiting turbulence in water flowing from said outlet, said curved portion of said passageway extending to one side of the rotary axis of said nozzle and the straight outlet section extending to the other side of the axis;

a tubular protective sleeve reciprocably mounted between said inner and outer housings and moveable with said inner housing for movement between a retracted position wherein said nozzle is encased therein and an extended position wherein said nozzle is cooperatively extended from said sleeve;

retracting means for biasing said second tubular housing and said sleeve to said retracted position, said retracting means comprises a first compression spring compressed between said first housing and a radial flange of said tubular sleeve for normally biasing said second housing and said sleeve to a retracted position within said first housing;

a second compression spring compressed between said radial flange of said tubular sleeve and a radial flange on said lower end of said second housing for normally biasing said second housing to a retracted position within said first housing; and said second housing and said sleeve being responsive to water pressure in said housing for extending said first housing and sleeve from said housing together to a first position wherein said sleeve is restrained from further movement and said second housing extending to a position for exposing the nozzle.

9. A sprinkler nozzle for distributing water from a source over an area of terrain comprising:

a body having an axis of rotation and an elongated passageway with an inlet for connecting to a source of water under pressure and an outlet orifice for directing a stream of water outward therefrom;

said passageway having an inlet axis coaxial of said axis of rotation with a curved passageway portion extending from said inlet to one side of said axis and to a straight portion extending from said axis to said outlet on an opposite side thereof and extending at an angle to said inlet and said axis of rotation; and means comprising multiple passageways in said curved portion of said passageway between said inlet and said outlet for inhibiting turbulence in water flowing along said passageway.

* * * * *